US011024211B2

(12) United States Patent
Chen

(10) Patent No.: US 11,024,211 B2
(45) Date of Patent: Jun. 1, 2021

(54) DRIVE CIRCUIT OF DISPLAY PANEL, DRIVING METHOD OF DRIVE CIRCUIT AND DISPLAY DEVICE

(71) Applicants: HKC Corporation Limited, Guangdong (CN); Chongqing HKC Optoelectronics Technology Co., Ltd., Chongqing (CN)

(72) Inventor: Yu-jen Chen, Chongqing (CN)

(73) Assignees: HKC Corporation Limited, Shenzhen (CN); Chongqing HKC Optoelectronics Technology Co., Ltd., Chongqing (CN)

( * ) Notice: Subject to any disclaimer, the term of this patent is extended or adjusted under 35 U.S.C. 154(b) by 27 days.

(21) Appl. No.: 16/625,949

(22) PCT Filed: Sep. 1, 2017

(86) PCT No.: PCT/CN2017/100255
§ 371 (c)(1),
(2) Date: Dec. 23, 2019

(87) PCT Pub. No.: WO2019/000634
PCT Pub. Date: Jan. 3, 2019

(65) Prior Publication Data

US 2020/0160770 A1 May 21, 2020

(30) Foreign Application Priority Data

Jun. 29, 2017 (CN) ..... 201710515676.8

(51) Int. Cl.
*G09G 3/20* (2006.01)

(52) U.S. Cl.
CPC ..... *G09G 3/20* (2013.01); *G09G 2300/08* (2013.01)

(58) Field of Classification Search
CPC ..... G09G 3/3688; G09G 3/20; G09G 2310/0267; G09G 2300/08; G09G 2310/0264
See application file for complete search history.

(56) References Cited

U.S. PATENT DOCUMENTS

2001/0022565 A1 9/2001 Kimura
2007/0285376 A1 12/2007 Hung
(Continued)

FOREIGN PATENT DOCUMENTS

CN 1627142 A 6/2005
CN 102144254 A 8/2011
(Continued)

*Primary Examiner* — Abbas I Abdulselam
(74) *Attorney, Agent, or Firm* — Muncy, Geissler, Olds & Lowe, P.C.

(57) ABSTRACT

A drive circuit and a driving method of a driving circuit, and a display device are provided. The driving circuit comprises: a drive chip comprising N signal lines disposed in order, wherein M signal lines of the N signal lines output a drive signal; and M selection modules, wherein each selection module comprises at least two signal input terminals, a signal output terminal and a control terminal. The signal output terminal is connected to a drive signal line, and the control terminal is connected to a control signal line. Each selection module is configured to control one of the signal input terminals to be connected to the corresponding signal output terminal, and the signal input terminals of the M selection modules, connected to the signal output terminals, are controlled to be correspondingly connected to M signal lines in an one-to-one manner according to a control signal.

18 Claims, 8 Drawing Sheets

(56) References Cited

U.S. PATENT DOCUMENTS

| | | | | |
|---|---|---|---|---|
| 2011/0187755 | A1 | 8/2011 | Choi et al. | |
| 2017/0178558 | A1* | 6/2017 | Zhou | G11C 19/28 |

FOREIGN PATENT DOCUMENTS

| | | | |
|---|---|---|---|
| CN | 103093733 | A | 5/2013 |
| CN | 103632640 | A | 3/2014 |
| CN | 103927962 | A | 7/2014 |
| CN | 104376821 | A | 2/2015 |
| CN | 204695749 | U | 10/2015 |
| CN | 106157902 | A | 11/2016 |
| CN | 107103889 | A | 8/2017 |

* cited by examiner

DRIVE CIRCUIT OF DISPLAY PANEL, DRIVING METHOD OF DRIVE CIRCUIT AND DISPLAY DEVICE

BACKGROUND

Technical Field

This disclosure relates to the technical field of a display, and for example to a drive circuit of a display panel, a driving method of the drive circuit and a display device.

Related Art

The thin film transistor liquid crystal display (TFT-LCD) is one of main varieties of the current flat panel displays, and has become an important display platform in the information technology (IT) and the video product. According to the main driving principle of the TFT-LCD, the system mainboard couples the R/G/B compression signal, the control signal and the power to the connector on the printed circuit board (PCB) through wires, and the data is processed by the timing controller (TCON) integrated chip (IC) on the PCB, and coupled to the display area through the PCB and through the source drive chip (also referred to as a source-chip on film (S-COF)) and the gate drive chip (also referred to as a gate-chip on film (G-COF), so that the TFT-LCD obtains the required power and signal.

With regard to different resolutions or driving architecture, the S-COFs or the G-COFs have different numbers of output channels. Exemplarily, the S-COF may have 1026, 966 or 960 output channels. In order to enhance the commonality of the S-COF, each of the three output channels adopts 1026 physical output channels, some channels of the 1026 physical channels are set to have no output through the hardware configuration, so that the actual effect of providing 966 or 960 output channels is finally achieved.

With regard to the implementation of 966 output channels in the practical application, the manufacturer usually adopts the setting that the $1^{st}$ to $30^{th}$ and the $997^{th}$ to $1026^{th}$ channels have no output. That is, 30 channels on two sides of the 1026 physical channels have no output. With regard to the implementation of 960 output channels, however, some manufacturers adopt the setting that the $1^{st}$ to $30^{th}$ and the $991^{st}$ to $1026^{th}$ channels have no output, while other manufacturers adopt the setting that the $1^{st}$ to $36^{th}$ and the $997^{th}$ to $1026^{th}$ channels have no output, so that the S-COFs of different manufacturers are incompatible in the mode of providing the 960 output channels. Similarly, with regard to the implementation of the output channels of the G-COF, the problem that the G-COFs of different manufacturers are not compatible under the same number of output channels also occurs. This brings some inconvenience to the driving of the TFT-LCD.

SUMMARY

This disclosure provides a drive circuit of a display panel, a driving method of the drive circuit and a display device to solve the problem that the display panel is not compatible with drive chips of different manufacturers.

This disclosure provides a drive circuit of a display panel, comprising:

a drive chip comprising N signal lines, wherein M signal lines of the N signal lines output a drive signal, where N is a positive integer, and M is a positive integer smaller than or equal to N; and M selection modules, wherein each of the M selection modules comprises at least two signal input terminals, a signal output terminal and a control terminal, wherein the signal output terminal is electrically connected to a drive signal line, and the control terminal is electrically connected to a control signal line.

Wherein each of the selection modules is configured to control one of the at least two signal input terminals of the selection module to be electrically connected to the corresponding signal output terminal, wherein the signal input terminals of the M selection modules, electrically connected to the signal output terminals, are controlled to be correspondingly electrically connected to the M signal lines in an one-to-one manner according to a control signal inputted from the control signal line.

The disclosure also provides a driving method of a drive circuit, comprising:

controlling a control signal line to input a control signal to control terminals of M selection modules, wherein each of the selection modules comprises at least two signal input terminals and a signal output terminal; and controlling one of the at least two signal input terminals in each of the selection modules to be electrically connected to the corresponding signal output terminal according to the control signal, wherein the signal input terminals of the M selection modules, electrically connected to the signal output terminals, are correspondingly electrically connected to M drive signal lines of a drive chip in an one-to-one manner, where M is a positive integer.

The disclosure further provides a drive circuit of a display panel, comprising:

a drive chip comprising N signal lines disposed in order, wherein M signal lines of the N signal lines output a drive signal, where N is a positive integer, and M is a positive integer smaller than or equal to N; and M selection modules, wherein each of the M selection modules comprises a first transistor and a second transistor, wherein a gate of the first transistor and a gate of the second transistor are electrically connected together to serve as the control terminal of the selection module, a source of the first transistor and a source of the second transistor respectively serve as a first signal input terminal and a second signal input terminal of the selection module, drains of the first transistor and the second transistor are electrically connected together to serve as a signal output terminal of the selection module, and the signal output terminal is electrically connected to a driving signal line.

The selection module further comprises a first bonding pad pair and a second bonding pad pair, the control terminal of the selection module is electrically connected to a first level signal terminal through the first bonding pad pair, and electrically connected to a second level signal terminal through the second bonding pad pair. Each of the first bonding pad pair and the second bonding pad pair is constituted by two mutually insulated bonding pads, when the first bonding pad pair turns on, the first level signal terminal is electrically connected to the control terminal, so that the first transistor turns on and the second transistor turns off, the first signal input terminal is electrically connected to the signal output terminal, and the first signal input terminals in the M selection modules are correspondingly electrically connected to M signal lines in an one-to-one manner; when the second bonding pad pair turns on, the second level signal terminal is electrically connected to the control terminal, so that the second transistor turns on and the first transistor turns off, the second signal input terminal is electrically connected to the signal output terminal, and the second signal input terminals in the M selection modules are correspondingly electrically connected to M signal lines in an one-to-one manner.

The disclosure also provides a display device comprising a display panel and any of the above-mentioned drive circuits.

DETAILED DESCRIPTION OF THE INVENTION

The embodiments of the invention will be apparent from the following detailed description, which proceeds with reference to the accompanying drawings, wherein the same references relate to the same elements.

Figure 1:
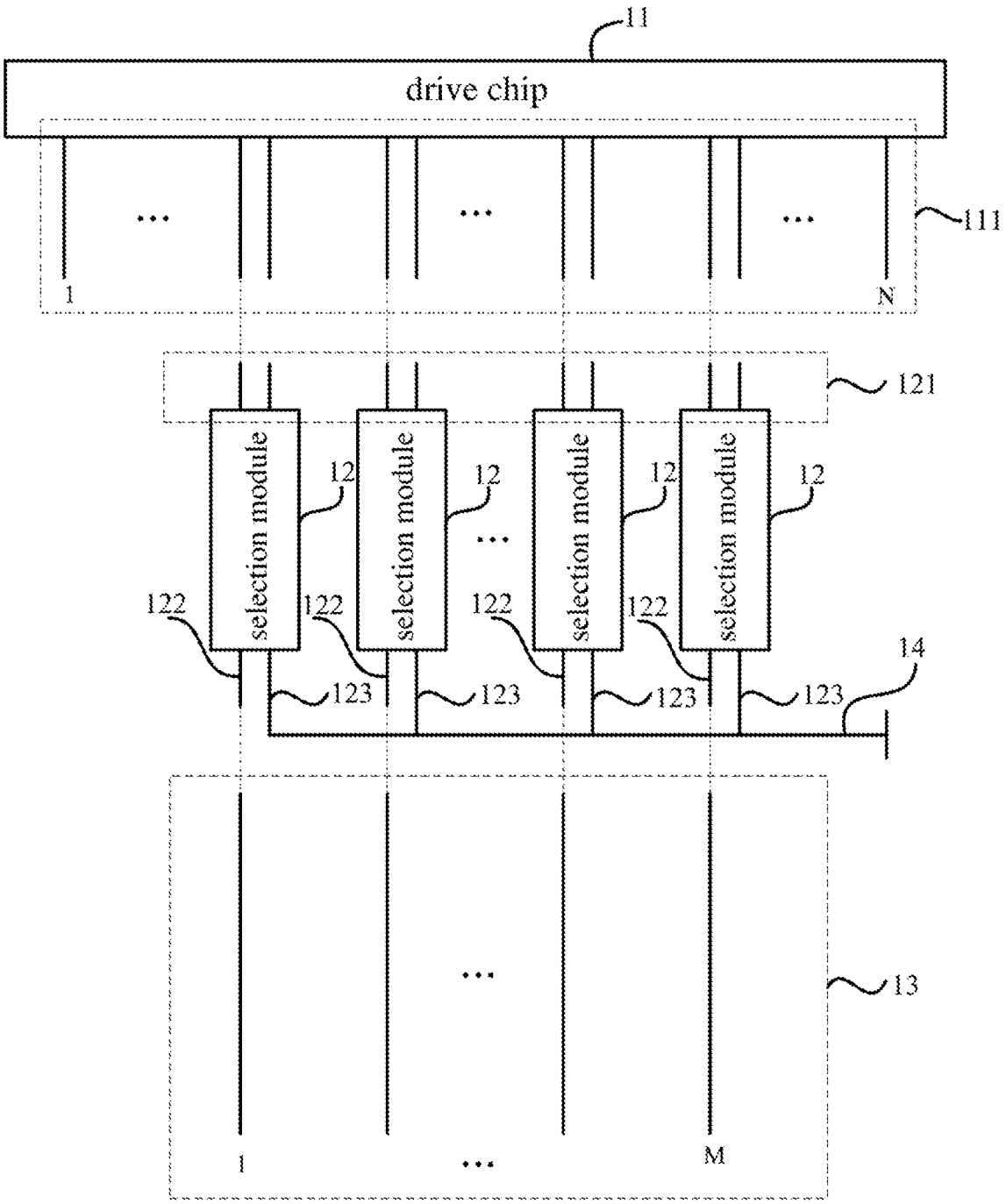
FIG. 1 is a schematic structure view showing a drive circuit of a display panel provided by this embodiment.

FIG. 1 is a schematic structure view showing a drive circuit of a display panel provided by this embodiment. Referring to FIG. 1, this embodiment provides a drive circuit of a display panel. The drive circuit includes a drive chip 11 and M selection modules 12.

The drive chip 11 includes N signal lines 111 disposed in order, and M signal lines 111 of the N signal lines 111 are used to output a drive signal, where N is a positive integer, and M is a positive integer smaller than or equal to N.

Each of the selection modules 12 includes at least two signal input terminals 121, a signal output terminal 122 and a control terminal 123, the signal output terminal 122 is electrically connected to a drive signal line 13, and the control terminal 123 is electrically connected to a control signal line 14.

The selection module 12 is configured to control one of the at least two signal input terminals 121 of the selection module 12 to be electrically connected to the corresponding signal output terminal 122, wherein the signal input terminals 121 of the M selection modules 12, electrically connected to the signal output terminals 122, are controlled to be correspondingly electrically connected to the M signal lines 111 in an one-to-one manner according to a control signal inputted from the control signal line 14.

In general, the drive chip 11 is configured to output a drive signal to the drive signal line 13 of the display panel through the signal line 111. However, with regard to the display panels with different resolutions or driving architecture, the number of the signal lines 111 of the drive chip 11 for outputting the drive signal is uncertain. If the number of the signal lines of the drive chip 11 disposed in order is N, then M or L signal lines thereof may be needed, where L is a positive integer smaller than or equal to N, and is unequal to M. Exemplarily, for the source drive chip 11, 1024 signal lines 111 are generally provided, the number of the signal lines 111 for outputting the drive signal is 966 or 960; and for different manufacturers, even if the number of the signal lines 111 for outputting the drive signal is the same (e.g., M), the sequences of the M signal lines 111 selected from the 1024 signal lines 111 are also different, so that the drive chips 11 produced by different manufacturers cannot be shared.

In order to solve the problem that the drive chips 11 cannot be shared among different manufacturers when the number of the signal lines 111 for outputting the drive signal is the same, the M selection modules 12 are correspondingly disposed between the M signal lines 111 and the M drive signal lines 13 corresponding to the M signal lines 111 in an one-to-one manner in this embodiment, the signal line 111 inputs the drive signal to the selection module 12 through the signal input terminal 121 of the corresponding selection module 12, and the selection module 12 transmits the drive signal to the drive signal line 13 of the display panel through the signal output terminal 122.

Each of the selection modules 12 includes at least two signal input terminals 121, and each signal input terminal 121 of the selection module 12 corresponds to different signal lines 111, so that the M selection modules 12 may select a predetermined arrangement mode of the M signal lines 111. Exemplarily, it is assumed that the drive chip 11 includes 1024 signal lines 111 disposed in order, the drive signal is outputted through 960 signal lines 111 therein, and 960 signal lines 111 have three predetermined arrangement modes, that is, the $31^{St}$ to $990^{th}$ signal lines 111, the $32^{nd}$ to 990 signal lines 111 and the $33^{rd}$ to $992^{nd}$ signal lines 111. In this case, each of the selection modules 12 may include three signal input terminals 121, the $i^{th}$ selection module 12 is set to include the three signal input terminals 121 with the serial numbers of AOUT i, BOUT i and COUT i, where "i" is a positive integer greater than 0 and smaller than and equal to 960. The signal input terminals 121 with the serial numbers of AOUT 1, AOUT 2, . . . , AOUT 960 may be respectively connected to the $31^{st}$ to $990^{th}$ signal lines 111 of the drive chip 11; the signal input terminals 121 with the serial numbers of BOUT 1, BOUT 2, . . . , BOUT 960 may be respectively connected to the $32^{nd}$ to $991^{st}$ signal lines 111 of the drive chip 11; and the signal input terminals 121 with the serial numbers of COUT 1, COUT 2, . . . , COUT 960 may be respectively connected to the $33^{rd}$ to $992^{nd}$ signal lines 111 of the drive chip 11. In FIG. 1, each of the selection modules 12 includes two signal input terminals 121 so that the drive chip 11 with two different arrangement modes may be shared.

The selection module 12 also includes a control terminal 123, each of the selection modules 12 corresponds to a control terminal 123, and the control terminal 123 is electrically connected to the control signal line 14. The control terminal 123 is used to control only one of the at least two signal input terminals 121 of the selection module 12 to be electrically connected to the signal output terminal 122 of the selection module 12 according to the control signal inputted from the control signal line 14 to complete the transmission of the drive signal.

In the drive circuit of the display panel provided by this embodiment, when the drive chip 11 outputs the drive signal through M signal lines 111, disposed according to the predetermined arrangement mode, in the N signal lines 111 disposed in order, the M selection modules 12 are disposed or set in order, wherein each of the selection modules 12 includes at least two signal input terminals 121, a signal output terminal 122 and a control terminal 123, wherein the control terminal 123 is electrically connected to the control signal line 14. The selection module 12 controls only one of the at least two signal input terminals 121 to be electrically connected to the corresponding signal output terminal 122, wherein the signal input terminals 121, correspondingly electrically connected to the signal output terminals 122, are controlled to be correspondingly electrically connected to M signal lines 111 in an one-to-one manner according to the control signal inputted from the control signal line 14. The drive signal is transmitted to the drive signal line of the display panel through the signal output terminal 122 of the selection module 12. The drive circuit of the display panel provided by this embodiment can implement the compatibility with different drive chips 11 when the display panel works with different drive chips 11, the sharing property of the drive chip 11 is improved, the management cost is reduced, and the development efficiency is improved.

The drive circuit provided by this embodiment can be applied to the display panel, and can also be applied to a circuit structure which needs to implement different connections and thus the compatibility. This embodiment provides no restriction.

Optionally, referring to FIG. 1, the control terminals 123 of the M selection modules 12 are electrically connected to the same control signal line 14, so that the interconnections can be decreased, and the unified control of the control signal line 14 on the M selection modules 12 can be implemented.

Optionally, the drive circuit is a gate drive circuit, and the drive signal line 13 of the display panel is a scan line; or the drive circuit is a source drive circuit, and the drive signal line 13 of the display panel is a data line.

The drive signal lines 13 are located in the display area of the display panel, and are correspondingly electrically connected to the signal output terminals 122 of the selection modules 12 in an one-to-one manner. When the drive circuit of the display panel is a gate drive circuit, the drive chip 11 is a gate drive chip for outputting a gate drive signal, and the drive signal line 13 is a scan line. When the drive circuit of the display panel is a source drive circuit, the drive chip 11 is a source drive chip for outputting a source drive signal, and the drive signal line 13 is a data line.

Optionally, the selection module 12 includes two signal input terminals 121, the value of N is 1024, and the value of M is 960. The predetermined arrangement mode of 960 signal lines 111 is the $31^{st}$ to $990^{th}$ signal lines 111 in the 1024 signal lines 111 disposed in order, or the $37^{th}$ to $996^{th}$ signal lines 111 in the 1024 signal lines 111 disposed in order. The drive chip 11, which is usually used, includes 1024 signal lines 111, and there are 960 signal lines 111 for outputting the drive signal. Some manufacturers adopt the arrangement mode that the $31^{st}$ to $990^{th}$ signal lines 111 output the drive signal, and some manufacturers adopt the arrangement mode that the $37^{th}$ to $996^{th}$ signal line 111*s* output the drive signal.

Figure 2:
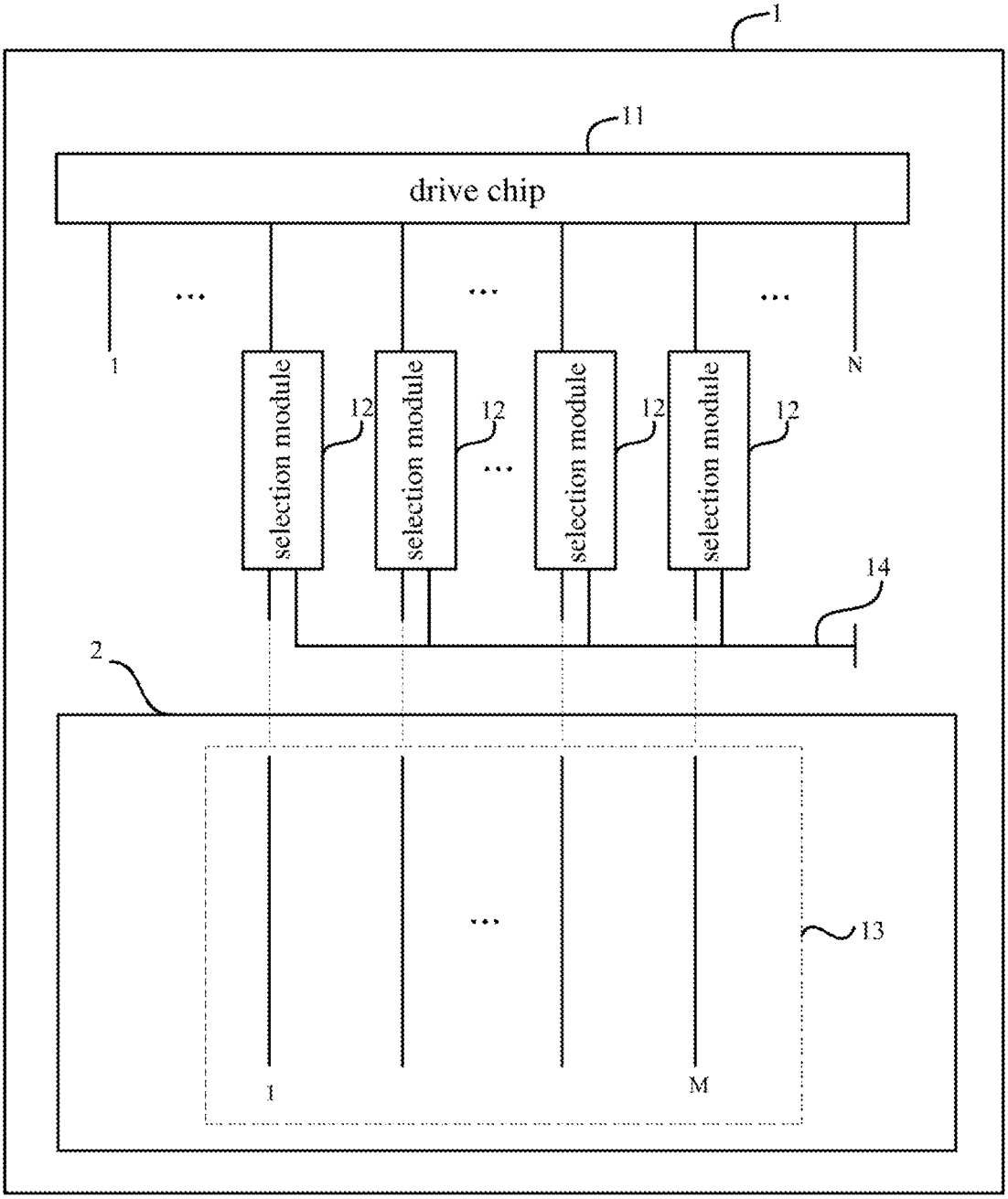
FIG. 2 is a schematic structure view showing a display panel provided by this embodiment.

FIG. 2 is a schematic structure view showing a display panel provided by this embodiment. Optionally, referring to FIG. 2, the display panel includes the drive circuit of the above-mentioned embodiment. A display panel 1 includes a display area 2 and a fan-out area surrounding the display area 2. The selection module 12 is disposed in the fan-out area, and the drive signal line 13 is disposed in the display area 2. It is obtained, from the above-mentioned embodiment, that the drive signal line 13 may be a scan line and may also be a data line. The selection module 12 is disposed in the fan-out area, so that the existing process of the display panel can be shared, and the cost can be saved. If the selection module 12 is disposed in the drive chip, then it is necessary to modify the circuit structure inside the drive chip, and the production cost is increased.

Figure 3:
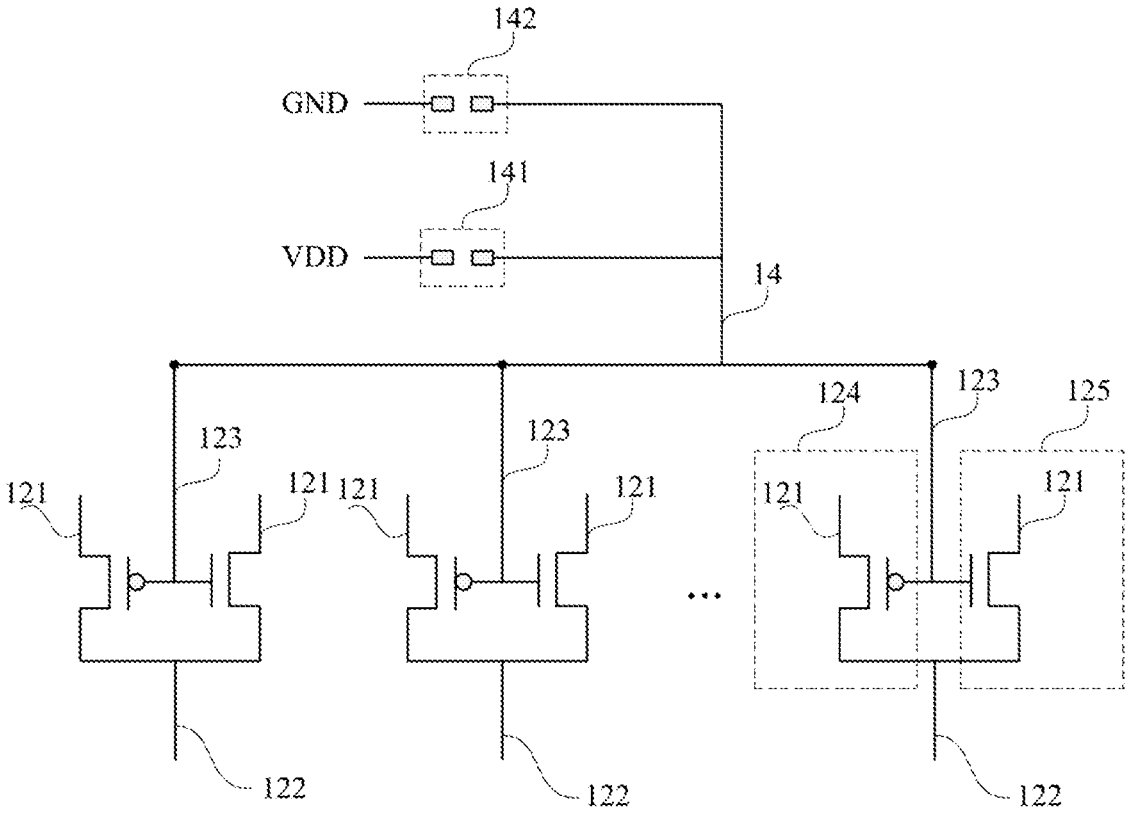
FIG. 3 is a schematic structure view showing a selection module of the drive circuit of the display panel provided by this embodiment.

FIG. 3 is a schematic structure view showing a selection module of the drive circuit of the display panel provided by this embodiment. On the basis of the above-mentioned embodiment, referring to FIGS. 1 and 3, each selection module 12 includes two signal input terminals 121. Each selection module 12 of the drive circuit includes a first transistor 124 and a second transistor 125. A gate of the first transistor 124 and a gate of the second transistor 125 are electrically connected together, a source of the first transistor 124 and a source of the second transistor 125 respectively serve as the signal input terminals 121 of the selection module 12, and drains of the first transistor 124 and the second transistor 125 are electrically connected together to serve as the signal output terminal 122 of the selection module 12.

Optionally, the first transistor is a P-type transistor, and the second transistor is an N-type transistor.

Each of the selection modules 12 includes a first transistor 124 and a second transistor 125. Each of the first transistor 124 and the second transistor 125 includes three terminals which are a source, a drain and a gate, respectively. The sources of the first transistor 124 and the second transistor 125 respectively serve as the signal input terminals 121 of the selection module 12, and the drains of the first transistor 124 and the second transistor 125 are electrically connected together to constitute the signal output terminal 122, so that the drive signal is transmitted to the drive signal line 13 through the source and the drain of the transistor. The gates of the first transistor 124 and the second transistor 125 are electrically connected together to constitute the control terminal 123, and the control terminal 123 is electrically connected to the control signal line 14.

The first transistor 124 is a P-type transistor, wherein when the gate voltage is a low level, the first transistor 124 turns on. The second transistor 125 is an N-type transistor, wherein when the gate voltage is a high level, the second transistor 125 turns on. If the control signal line 14M is set to the low level GND, then the control terminal 123 of each of the selection modules 12 is the low level, and the first transistor 124 turns on so that the drive signal is inputted from the source of the first transistor 124 (i.e., the signal input terminal 121), and is outputted to the drive signal line 13 through the drain of the first transistor 124 (i.e., the signal output terminal 122). If the control signal line 14M is set to the high level VDD, then the control terminal 123 of each of the selection modules 12 is the high level, and the second transistor 125 turns on so that the drive signal is inputted from the source of the second transistor 125 (i.e., the signal input terminal 121), and is outputted to the drive signal line 13 through the drain of the second transistor 125 (i.e., the signal output terminal 122).

In addition, it is also possible to configure the first transistor 124 as the N-type transistor, and configure the second transistor 125 as the P-type transistor, and the gate voltage is adjusted when the first transistor 124 or the second transistor 125 is controlled to turn on.

If the M signal lines of the drive chip 11 for outputting the drive signal are correspondingly connected to the signal input terminals 121 of M first transistors (N-type transistors) 124 in an one-to-one manner, then the control signal line 14M is set to the low level. If the M signal lines of the drive chip 11 for outputting the drive signal are correspondingly connected to the signal input terminals 121 of the M second transistors (P-type transistors) 125 in an one-to-one manner, then the control signal line 14M is set to the high level. Thus, the compatibility between the drive chips 11 of the two different output channels can be implemented.

Optionally, the first transistor 124 is a P-type metal-oxide-semiconductor field-effect transistor (MOSFET), and the second transistor 125 is an N-type metal-oxide-semiconductor field-effect transistor (MOSFET). Since the thin film transistors of the display area of the display panel are MOSFETs, the process for forming the first transistor 124 and the second transistor 125, which are both MOSFETs, can adopt the existing process of the thin film transistor in the display panel, so that the operation is simple, and the cost is saved.

Optionally, referring FIG. 3, the selection module 12 also includes a first bonding pad pair 141 and a second bonding pad pair 142, the control terminal 123 of the selection module 12 is electrically connected to the first level signal terminal (e.g., the high level signal terminal) through the first bonding pad pair 141; and is electrically connected to the second level signal terminal (e.g., the low level signal terminal) through the second bonding pad pair 142. Each of the first bonding pad pair 141 and the second bonding pad pair 142 is constituted by two mutually insulated bonding pads, and only one of the first bonding pad pair 141 and the second bonding pad pair 142 turns on at the same time.

The first bonding pad pair 141 and the second bonding pad pair 142 are equivalent to two switches. When the switch is closed, the control signal line 14 is electrically connected to the level signal terminal to which the switch is connected, and only one of the first bonding pad pair 141 and the second bonding pad pair 142 turns on at the same time because the power supply will be damaged if both of them turn on at the same time. When the first bonding pad pair 141 or the second bonding pad pair 142 needs to turn on, two mutually insulated bonding pads can be electrically connected by the electroconductive substance, such as a conductive adhesive or the like. In the related art, when the drive chip 11 is bonded to the display panel, the metal bonding pad on the drive chip 11 is bonded to a reserved metal bonding pad on the display panel through the substance, such as the conductive adhesive or the like. This solution can utilize the process of the related art to dispose the first bonding pad pair 141 and the second bonding pad pair 142 in a simple manner.

Figure 4:
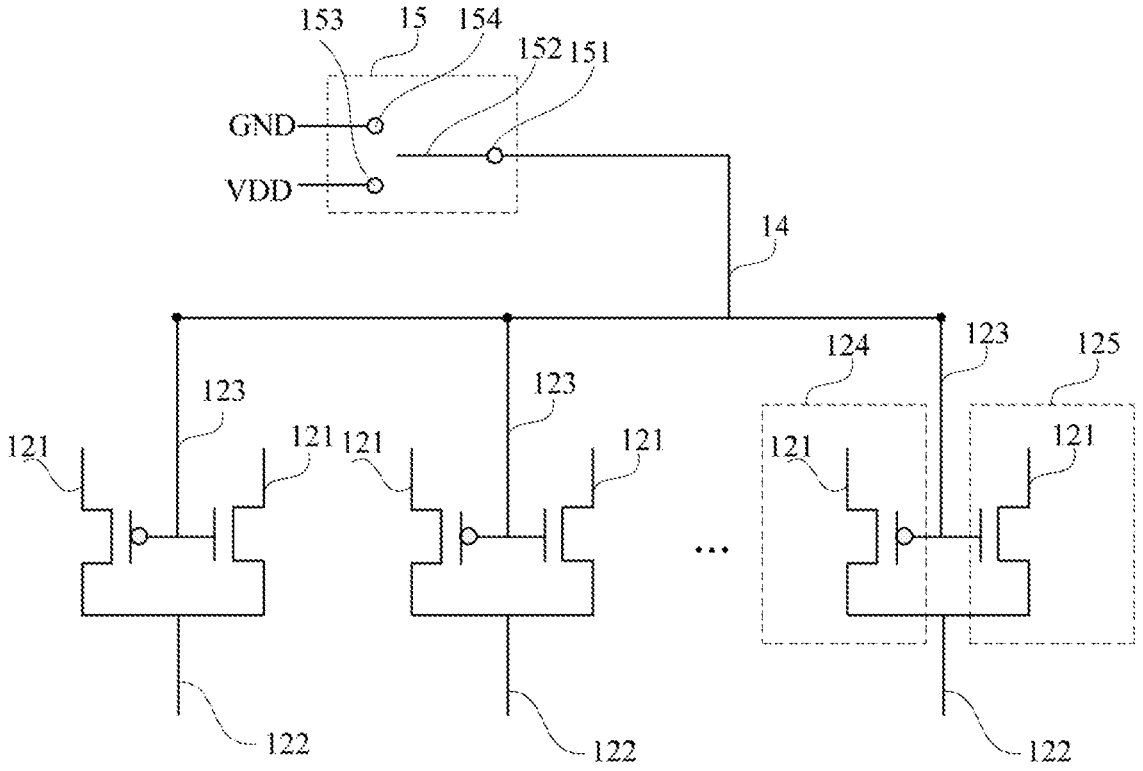
FIG. 4 is a schematic structure view showing a selection module of another drive circuit of the display panel provided by this embodiment.

FIG. 4 is a schematic structure view showing a selection module of another drive circuit of the display panel provided by this embodiment. Referring to FIG. 4, the selection module also includes a single pole double throw switch 15, which includes an output terminal 151, a connector 152, a first input terminal 153 and a second input terminal 154. A first terminal of the connector 152 is electrically connected to the output terminal 151, the output terminal 151 is electrically connected to the control signal line 14, the first input terminal 153 is electrically connected to the first level signal terminal VDD, and the second input terminal 154 is electrically connected to the second level signal terminal GND. When a second terminal of the connector 152 is electrically connected to the first input terminal 153, the first level signal terminal VDD is electrically connected to the control signal line 14. When the second terminal of the connector 152 is electrically connected to the second input terminal 154, the second level signal terminal GND is electrically connected to the control signal line 14. Using the single pole double throw switch 15 to control the level signal terminal to which the control signal line 14 is connected can ensure that only one terminal in the first level signal terminal VDD (e.g., the high level signal terminal) and the second level signal terminal GND (e.g., the low level signal terminal) is electrically connected to the control signal line 14 at a certain time.

Figure 5:
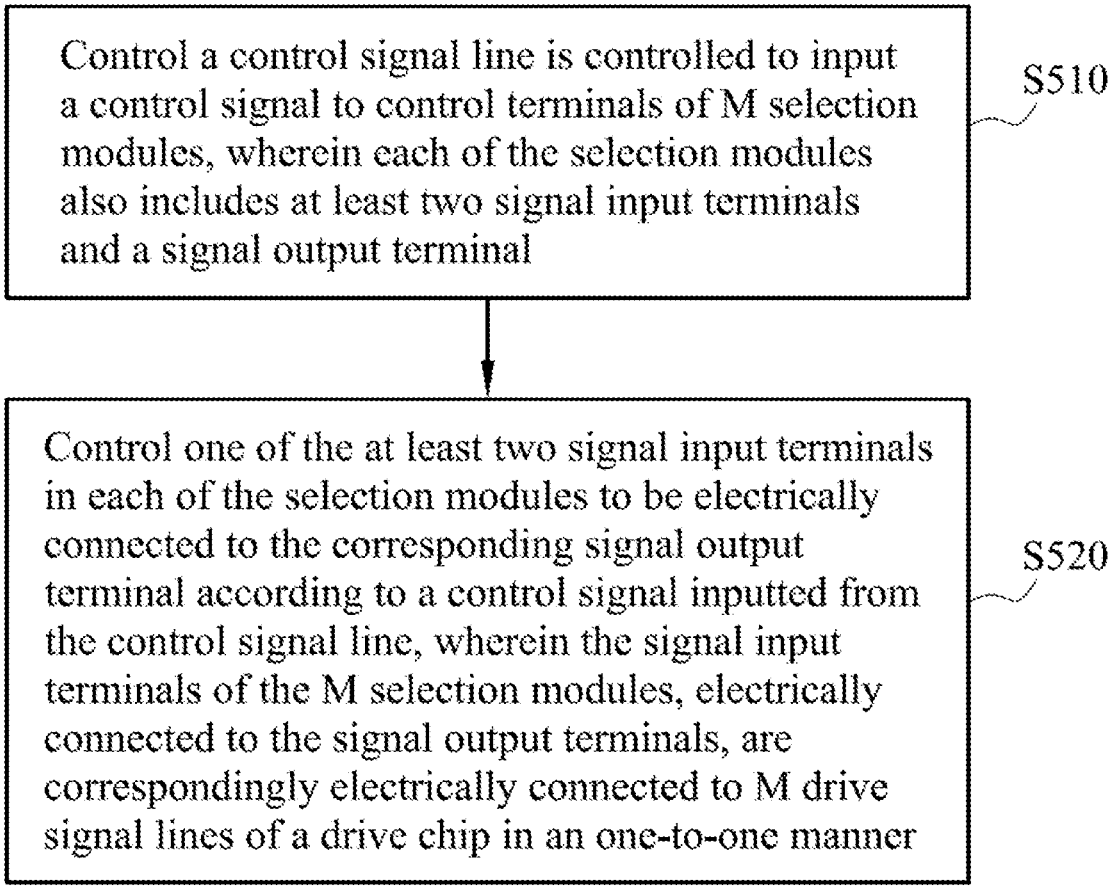
FIG. 5 is a flow chart showing a driving method of a drive circuit of a display panel provided by this embodiment.

This embodiment also provides a driving method of a drive circuit of a display panel, which may be used to drive the drive circuit of any of the embodiments described above. Referring to FIG. 5, the driving method includes the following steps S510 and S520.

In the step S510, a control signal line is controlled to input a control signal to control terminals of M selection modules, wherein each of the selection modules also includes at least two signal input terminals and a signal output terminal.

In the step S520, one of the at least two signal input terminals in each of the selection modules is controlled to be electrically connected to the corresponding signal output terminal according to a control signal inputted from the control signal line, wherein the signal input terminals of the M selection modules, electrically connected to the signal output terminals, are correspondingly electrically connected to M drive signal lines of a drive chip in an one-to-one manner.

The drive chip includes N signal lines disposed in order, wherein M signal lines are used to output a drive signal, where N is a positive integer, and M is a positive integer smaller than or equal to N.

In the drive circuit of the display panel provided by this embodiment, when the drive chip outputs the drive signal through M signal lines, disposed according to the predetermined arrangement mode, in the N signal lines disposed in order, the M selection modules are disposed or set in order, wherein each of the selection modules includes at least two signal input terminals, a signal output terminal and a control terminal, wherein the control terminal is electrically connected to the control signal line. The selection module controls one of the at least two signal input terminals to be electrically connected to the corresponding signal output terminal, wherein the signal input terminals, correspondingly electrically connected to the signal output terminals, are controlled to be correspondingly electrically connected to M signal lines in an one-to-one manner according to the control signal inputted from the control signal line. The drive signal is transmitted to the drive signal line of the display panel through the signal output terminal of the selection module. The drive circuit of the display panel provided by this embodiment can implement the compatibility with different drive chips when the display panel works with different drive chips, the sharing property of the drive chip is improved, the management cost is reduced, and the development efficiency is improved.

On the basis of the above-mentioned embodiment, optionally, controlling the control signal line to input the control signal to the M selection modules includes: controlling a control signal line to input a control signal to the control terminals of the M selection modules, wherein each of the selection modules includes a first transistor and a second transistor, wherein gates of the first transistor and the second transistor are electrically connected together to constitute the control terminal; and controlling the one of the at least two signal input terminals in each of the selection modules to be electrically connected to the corresponding signal output terminal according to the control signal, which includes: controlling a source of one of the first transistor and the second transistor in each of the selection modules to be electrically connected to the corresponding signal output terminal according to the control signal, wherein the signal output terminal is constituted by drains of the first transistor and the second transistor electrically connected together.

Figure 6:
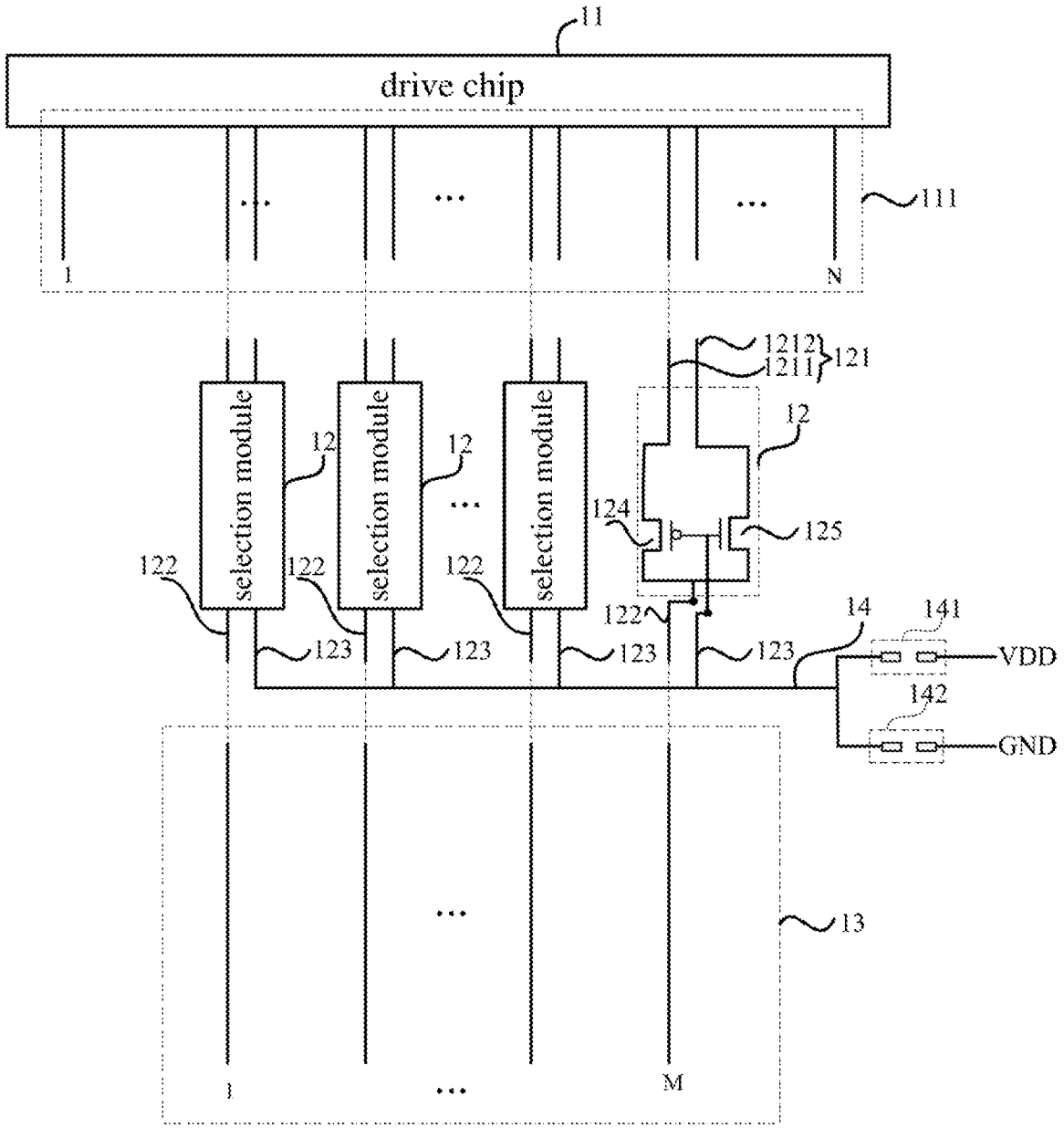
FIG. 6 is a schematic structure view showing still another drive circuit of the display panel provided by this embodiment.

FIG. 6 is a schematic structure view showing still another drive circuit of the display panel provided by this embodiment. Referring to FIG. 6, this embodiment also provides a drive circuit of a display panel. The drive circuit includes a drive chip 11 and M selection modules 12.

The drive chip 11 includes N signal lines 111 disposed in order, and M signal lines 111 of the N signal lines 111 are used to output a drive signal, where N is a positive integer, and M is a positive integer smaller than or equal to N.

Each of the selection modules 12 includes a first transistor 124 and a second transistor 125. A gate of the first transistor 124 and a gate of the second transistor 125 are electrically connected together to serve as the control terminal 123 of the selection module 12, and a source of the first transistor 124 and a source of the second transistor 125 respectively serve as two signal input terminals 121 of the selection module 12. The above-mentioned two signal input terminals 121 include first signal input terminals 1211 and second signal input terminals 1212, drains of the first transistor 124 and the second transistor 125 are electrically connected together to serve as the signal output terminal 122 of the selection module 12, and the signal output terminal 122 is electrically connected to the drive signal line 13.

The selection module 12 also includes a first bonding pad pair 141 and a second bonding pad pair 142. The control terminal 123 is electrically connected to the first level signal terminal VDD through the first bonding pad pair 141, and is electrically connected to the second level signal terminal GND through the second bonding pad pair 142.

Each of the first bonding pad pair 141 and the second bonding pad pair 142 is constituted by two mutually insulated bonding pads. When the first bonding pad pair 141 turns on, the first level signal terminal VDD is electrically connected to the control terminal 123, so that the first transistor 124 turns on and the second transistor 125 turns off, the first signal input terminal 1211 is electrically connected to the signal output terminal 122, and the first signal input terminals 1211 in the M selection modules 12 are correspondingly electrically connected to M signal lines 111 in an one-to-one manner. When the second bonding pad pair 142 turns on, the second level signal terminal GND is electrically connected to the control terminal 123, so that the second transistor 125 turns on and the first transistor 124 turns off, the second signal input terminal 1212 is electrically connected to the signal output terminal 122, and the second signal input terminals 1212 in the M selection modules 12 are correspondingly electrically connected to M signal lines 111 in an one-to-one manner.

In the drive circuit of the display panel provided by this embodiment, when the drive chip 11 outputs the drive signal through M signal lines 111, disposed according to the predetermined arrangement mode, in the N signal lines 111 disposed in order, the M selection modules 12 are disposed or set in order, wherein each of the selection modules 12 includes at least two signal input terminals 121, a signal output terminal 122 and a control terminal 123, wherein the control terminal 123 is electrically connected to the control signal line 14. The selection module 12 controls only one of the at least two signal input terminals 121 to be electrically connected to the corresponding signal output terminal 122, wherein the signal input terminals 121, correspondingly electrically connected to the signal output terminals 122, are controlled to be correspondingly electrically connected to M signal lines 111 in an one-to-one manner according to the control signal inputted from the control signal line 14. The drive signal is transmitted to the drive signal line of the display panel through the signal output terminal 122 of the selection module 12. The drive circuit of the display panel provided by this embodiment can implement the compatibility with different drive chips 11 when the display panel works with different drive chips 11, the sharing property of the drive chip 11 is improved, the management cost is reduced, and the development efficiency is improved.

Optionally, the first transistor is a P-type transistor, and the second transistor is an N-type transistor.

Optionally, each of the P-type transistor and the N-type transistor is a metal-oxide-semiconductor field-effect transistor (MOSFET). Since the thin film transistors of the display area of the display panel are MOSFETs, the process for forming the first transistor 124 and the second transistor 125, which are both MOSFETs, can adopt the existing process of the thin film transistor in the display panel, so that the operation is simple, and the cost is saved.

Optionally, the control terminals of the M selection modules are electrically connected to the same control signal line, so that the interconnections can be decreased, and the unified control of the control signal line on the M selection modules can be implemented.

Optionally, the drive circuit is a gate drive circuit, and the drive signal line of the display panel is a scan line; or the drive circuit is a source drive circuit, and the drive signal line of the display panel is a data line.

Figure 7:
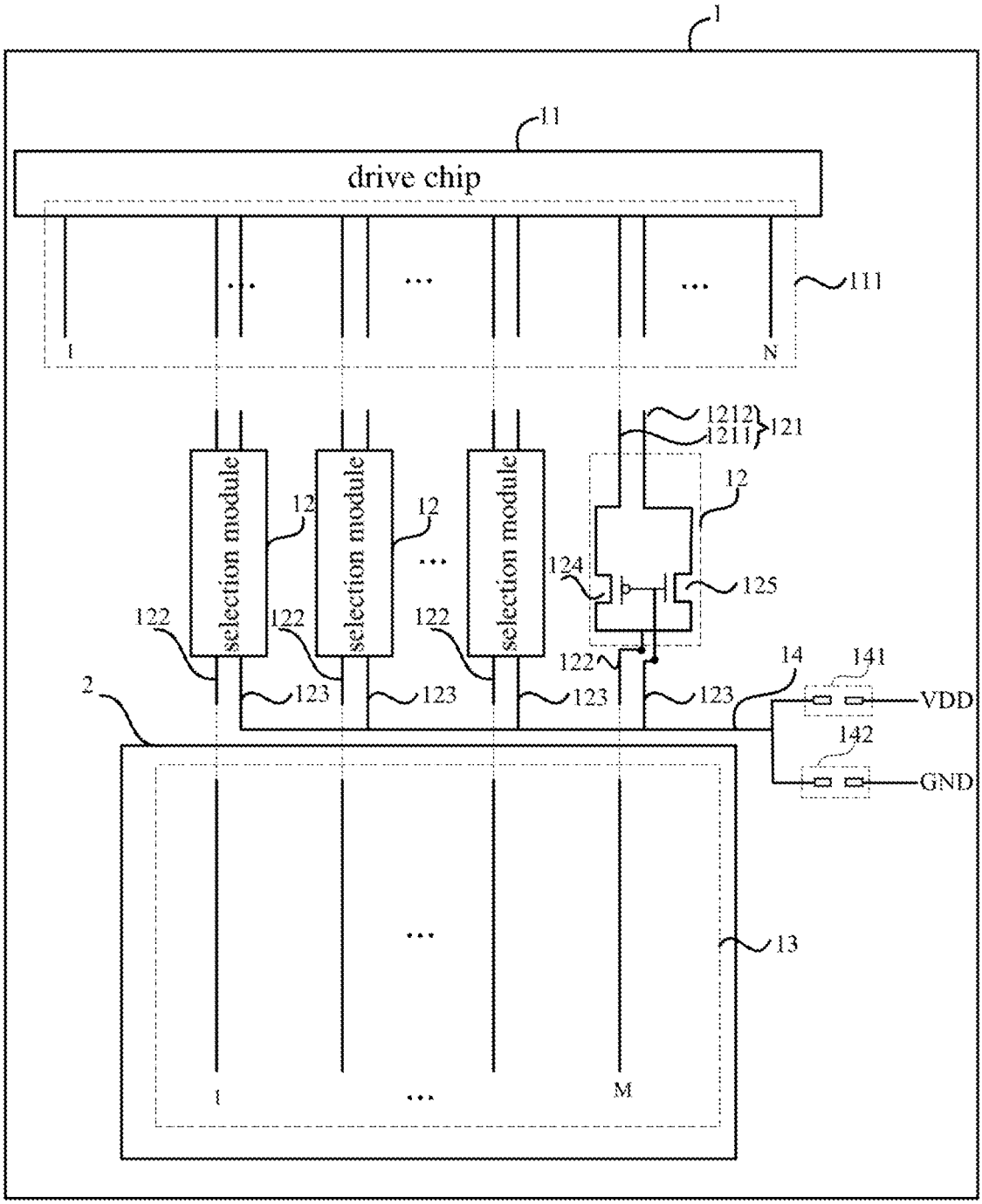
FIG. 7 is a schematic structure view showing still another display panel provided by this embodiment.

Optionally, the display panel includes a display area and a fan-out area surrounding the display area. The selection module is disposed in the fan-out area, and the drive signal line is disposed in the display area. FIG. 7 is a schematic structure view showing still another display panel provided by this embodiment. Referring to FIG. 7, the display panel includes the drive circuit of the above-mentioned embodiment. A display panel 1 includes a display area 2 and a fan-out area surrounding the display area 2. The selection module 12 is disposed in the fan-out area, and the drive signal line 13 is disposed in the display area 2. It is obtained, from the above-mentioned embodiment, that the drive signal line 13 may be a scan line and may also be a data line. The selection module 12 is disposed in the fan-out area, so that the existing process of the display panel can be shared, and the cost can be saved. If the selection module 12 is disposed in the drive chip, then it is necessary to modify the circuit structure inside the drive chip, and the production cost is increased.

Figure 8:
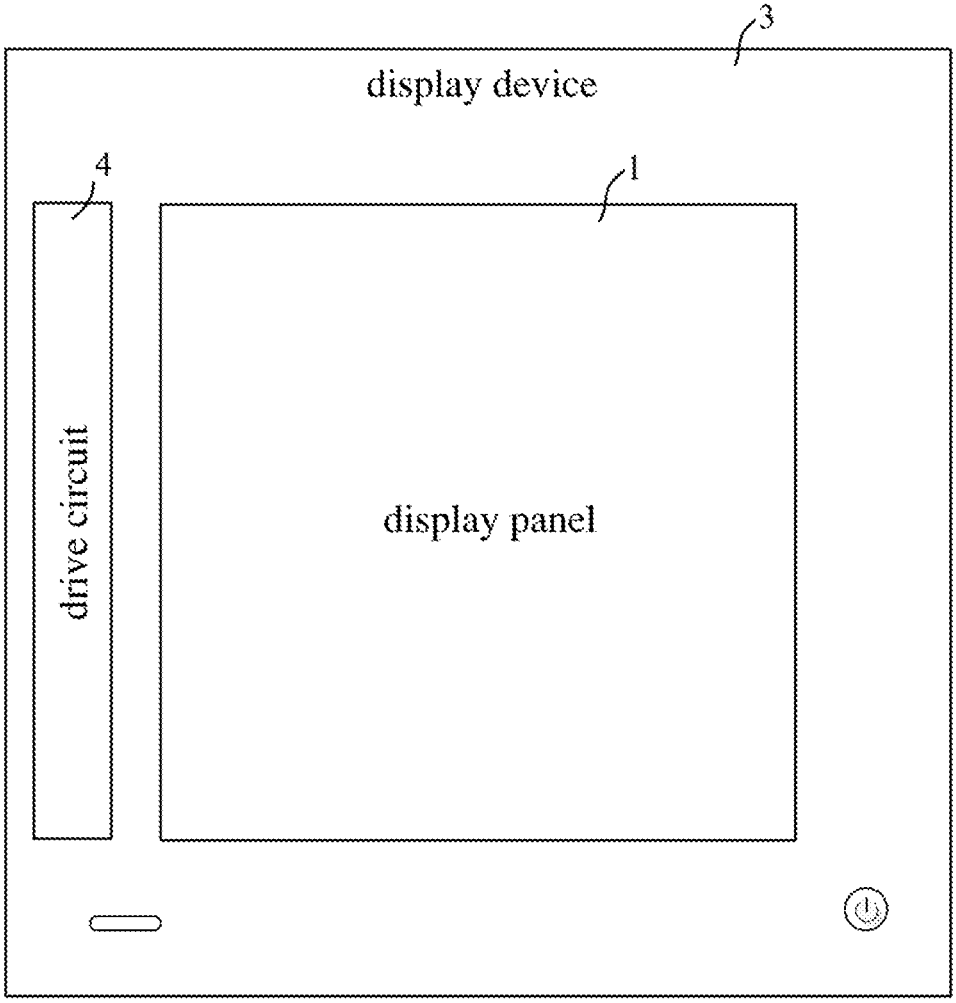
FIG. 8 is a schematic structure view showing a display device provided by this embodiment.

FIG. 8 is a schematic structure view showing a display device provided by this embodiment. This embodiment also provides a display device. Referring to FIG. 8, a display device 3 includes the display panel 1; and a drive circuit 4 provided by any of the embodiments.

In some embodiments, the display panel can be, for example, a liquid crystal display panel, an OLED (organic light-emitting diode) display panel, a QLED (quantum dot light-emitting diodes) display panel, a curved display panel, or other display panels.

What is claimed is:

1. A drive circuit of a display panel, comprising: a drive chip comprising N signal lines, wherein M signal lines of the N signal lines output a drive signal, and N is a positive integer, and M is a positive integer smaller than or equal to N; and M selection modules each comprising at least two signal input terminals, a signal output terminal and a control terminal, wherein the signal output terminal is electrically connected to a drive signal line, and the control terminal is electrically connected to a control signal line; wherein each of the selection modules is configured to control one of the at least two signal input terminals of the selection module to be electrically connected to the corresponding signal output terminal, and the signal input terminals of the M selection modules, electrically connected to the signal output terminals, are controlled to be correspondingly electrically connected to the M signal lines in an one-to-one manner according to a control signal inputted from the control signal line, wherein the selection module further comprises: a first transistor and a second transistor, wherein a gate of the first transistor and a gate of the second transistor are electrically connected together to serve as the control terminal of the selection module, a source of the first transistor and a source of the second transistor respectively serve as the signal input terminals of the selection module, and drains of the first transistor and the second transistor are electrically connected together to serve as the signal output terminal of the selection module.

2. The drive circuit according to claim 1, wherein the first transistor is a P-type transistor, and the second transistor is an N-type transistor.

3. The drive circuit according to claim 2, wherein each of the P-type transistor and the N-type transistor is a metal-oxide-semiconductor field-effect transistor (MOSFET).

4. The drive circuit according to claim 1, wherein the selection module further comprises a first bonding pad pair and a second bonding pad pair, the control terminal of the selection module is electrically connected to a first level signal terminal through the first bonding pad pair, and electrically connected to a second level signal terminal through the second bonding pad pair; wherein each of the first bonding pad pair and the second bonding pad pair is constituted by two mutually insulated bonding pads, and only one of the first bonding pad pair and the second bonding pad pair turns on at the same time.

5. The drive circuit according to claim 1, wherein the selection module further comprises a single pole double throw switch, and the single pole double throw switch comprises an output terminal, a connector, a first input terminal and a second input terminal, a first terminal of the connector is electrically connected to the output terminal, the output terminal is electrically connected to the control signal line, the first input terminal is electrically connected to a first level signal terminal, and the second input terminal is electrically connected to a second level signal terminal; when a second terminal of the connector is electrically connected to the first input terminal, the first level signal terminal is electrically connected to the control signal line; and when the second terminal of the connector is electrically connected to the second input terminal, the second level signal terminal is electrically connected to the control signal line.

6. The drive circuit according to claim 1, wherein the control terminals of the M selection modules are electrically connected to the same control signal line.

7. The drive circuit according to claim 1, wherein the display panel comprises a display area and a fan-out area surrounding the display area, the selection module is disposed in the fan-out area, and the drive signal line is disposed in the display area.

8. The drive circuit according to claim 1, wherein: the drive circuit is a gate drive circuit, and the drive signal line of the display panel is a scan line; or the drive circuit is a source drive circuit, and the drive signal line of the display panel is a data line.

9. The drive circuit according to claim 1, wherein N is 1024, and M is 960.

10. A display device, comprising: a display panel; and a drive circuit according to claim 1.

11. The drive device according to claim 10, wherein the display panel is a liquid crystal display panel, an organic light emitter diode display panel, or a quantum dot light-emitting diode (LED) display panel.

12. A driving method of a drive circuit, the driving method comprising: controlling a control signal line to input a control signal to control terminals of M selection modules, wherein each of the selection modules comprises at least two signal input terminals and a signal output terminal; and controlling one of the at least two signal input terminals in each of the selection modules to be electrically connected to the corresponding signal output terminal according to the control signal, wherein the signal input terminals of the M selection modules, electrically connected to the signal output terminals, are correspondingly electrically connected to M drive signal lines of a drive chip in an one-to-one manner, and M is a positive integer, wherein controlling the control signal line to input the control signal to the control terminals of the M selection modules comprises: controlling a control signal line to input the control signal to the control terminals of the M selection modules, wherein each of the selection modules further comprises a first transistor and a second transistor, and gates of the first transistor and the second transistor are electrically connected together to constitute the control terminal; wherein controlling the one of the at least two signal input terminals in each of the selection modules to be electrically connected to the corresponding signal output terminal according to the control signal comprises: controlling a source of one of the first transistor and the second transistor in each of the selection modules to be electrically connected to the corresponding signal output terminal according to the control signal, wherein the signal output terminal is constituted by drains of the first transistor and the second transistor electrically connected together.

13. A drive circuit of a display panel, comprising: a drive chip comprising N signal lines disposed in order, wherein M signal lines of the N signal lines output a drive signal, N is a positive integer, and M is a positive integer smaller than or equal to N; and M selection modules each comprising a first transistor and a second transistor, wherein a gate of the first transistor and a gate of the second transistor are electrically connected together to serve as the control terminal of the selection module, a source of the first transistor and a source of the second transistor respectively serve as a first signal input terminal and a second signal input terminal of the selection module, drains of the first transistor and the second transistor are electrically connected together to serve as a signal output terminal of the selection module, and the signal output terminal is electrically connected to a driving signal line; wherein the selection module further comprises a first bonding pad pair and a second bonding pad pair, the control terminal of the selection module is electrically connected to a first level signal terminal through the first bonding pad pair, and electrically connected to a second level signal terminal through the second bonding pad pair; wherein each of the first bonding pad pair and the second bonding pad pair is constituted by two mutually insulated bonding pads, when the first bonding pad pair turns on, the first level signal terminal is electrically connected to the control terminal, so that the first transistor turns on and the second transistor turns off, the first signal input terminal is electrically connected to the signal output terminal, and the first signal input terminals in the M selection modules are correspondingly electrically connected to M signal lines in an one-to-one manner; when the second bonding pad pair turns on, the second level signal terminal is electrically connected to the control terminal, so that the second transistor turns on and the first transistor turns off, the second signal input terminal is electrically connected to the signal output terminal, and the second signal input terminals in the M selection modules are correspondingly electrically connected to M signal lines in an one-to-one manner.

14. The drive circuit according to claim 13, wherein the first transistor is a P-type transistor, and the second transistor is an N-type transistor.

15. The drive circuit according to claim 14, wherein each of the P-type transistor and the N-type transistor is a metal-oxide-semiconductor field-effect transistor (MOSFET).

16. The drive circuit according to claim 13, wherein the control terminals of the M selection modules are electrically connected to the same control signal line.

17. The drive circuit according to claim 13, wherein the display panel comprises a display area and a fan-out area surrounding the display area, the selection module is disposed in the fan-out area, and the drive signal line is disposed in the display area.

18. The drive circuit according to claim 13, wherein: the drive circuit is a gate drive circuit, and the drive signal line of the display panel is a scan line; or the drive circuit is a source drive circuit, and the drive signal line of the display panel is a data line.

* * * * *